US010211578B2

(12) United States Patent
Ma

(10) Patent No.: US 10,211,578 B2
(45) Date of Patent: Feb. 19, 2019

(54) AUDIO OUTPUT JACK

(71) Applicant: Qi Ma, Okemos, MI (US)

(72) Inventor: Qi Ma, Okemos, MI (US)

( * ) Notice: Subject to any disclaimer, the term of this patent is extended or adjusted under 35 U.S.C. 154(b) by 0 days.

(21) Appl. No.: 15/874,372

(22) Filed: Jan. 18, 2018

(65) Prior Publication Data

US 2018/0212375 A1 Jul. 26, 2018

Related U.S. Application Data

(60) Provisional application No. 62/447,676, filed on Jan. 18, 2017.

(51) Int. Cl.

| | |
|---|---|
| ***H01R 24/58*** | (2011.01) |
| ***G10H 3/18*** | (2006.01) |
| ***H01R 31/00*** | (2006.01) |
| ***G10H 1/32*** | (2006.01) |
| *H01R 103/00* | (2006.01) |
| *H01R 105/00* | (2006.01) |

(52) U.S. Cl.

CPC ..... *H01R 24/58* (2013.01); *G10H 1/32* (2013.01); *G10H 3/186* (2013.01); *H01R 31/005* (2013.01); *H01R 2103/00* (2013.01); *H01R 2105/00* (2013.01)

(58) Field of Classification Search

CPC ..... H01R 24/58

See application file for complete search history.

(56) References Cited

U.S. PATENT DOCUMENTS

| | | | | |
|---|---|---|---|---|
| 4,519,287 | A * | 5/1985 | Naruse | H01R 24/58 200/51 R |
| 7,056,127 | B2 * | 6/2006 | Suzuki | H01R 13/6205 439/22 |
| 7,264,479 | B1 * | 9/2007 | Lee | H01R 11/30 439/39 |
| 2011/0076873 | A1 * | 3/2011 | Fonzo | H01R 35/02 439/485 |
| 2018/0138623 | A1 * | 5/2018 | Feng | H01R 13/2407 |

* cited by examiner

*Primary Examiner* — James Harvey

(74) *Attorney, Agent, or Firm* — The Weintraub Group, P.L.C.

(57) ABSTRACT

A mono audio output jack for an electrical instrument includes at a positive contact member and a ground contact member, the positive contact member partially insertable into the ground contact member. A conductive contact ring is disposed about each contact member. An audio plug is centrally disposed with the contact members and the contact rings. The jack hereof is adapted to receive a medial contact member and associated ring to define a stereo jack.

17 Claims, 23 Drawing Sheets

AUDIO OUTPUT JACK

CROSS-REFERENCE TO RELATED APPLICATIONS

This application is a completion application of co-pending U.S. Provisional Patent No. 62/447,676, filed Jan. 18, 2017, for an "AUDIO OUTPUT JACK", the disclosure of which is hereby incorporated by reference in its entirety, including the drawing.

BACKGROUND OF THE INVENTION

1. Field of the Invention

The present invention pertains to audio output jacks. More particularly, the present invention concerns audio output jacks for engaging an audio cable and transmitting a signal to an external audio input device. Even more particularly, the present invention relates to audio output jacks for use with electrical musical instruments.

2. Description of Related Art

In either an electric or an acoustic-electric musical instrument, such as a guitar, bass, mandolin, ukulele, etc., the instrument includes a pickup device for obtaining an electrical signal caused by vibrations of its strings. An audio output jack installed within the body of the instrument transmits the electrical signal to an audio input device, such as an amplifier, pedal, audio recorder, or the like. An audio cable having plugs on opposing ends for interconnecting the audio output jack and the input device. Typically, such plugs on such audio cables include an elongated sleeve and a tip for forming part of an electrical circuit.

Presently known audio output jacks, generally, include a pair of electrical contacts for attaching corresponding lead wires from the pickup device of the instrument to the output jack. Typically, one of the electrical contacts is a negative contact, which functions to ground the electrical connection, and the other electrical contact is a positive contact. The positive contact includes an elongated contact having a bend formed therein to facilitate contact between the tip of the audio output jack and the plug of the audio cable. Once the plug is inserted into the jack of the instrument, the bend engages the tip of the plug and forms a completed electrical circuit.

Usually, when presently known plugs are inserted into the audio output jack of such an instrument, the tip comes into contact with the grounded portion of the jack. This can produce an undesired audio feedback that can damage a connected audio input device.

A number of other disadvantages are exhibited in this structure, such as wasted material on the positive contact, the positive contact becoming deformed and/or deteriorated due to repeated use, debris accumulating around the contacts, and the like which can ultimately lead to having to replace the entire audio output jack.

The prior art has addressed this situation by proposing various alternatives to this typical structure.

For example, U.S. Pat. No. 4,519,287 to Naruse, which issued May 28, 1985, teaches an audio output jack for use in an electric guitar that is disposed outside of the guitar body itself. The jack includes an enclosed structure which prevents debris from becoming lodged between components of the device and maintains a clean electrical connection between the plug and the electrical contacts. Nonetheless, the jack utilizes a pair of electrical contacts or springs having bends formed on the ends thereof for engaging the tip and the sleeve of the plug. As noted above, these bends in the contacts become deformed over time and lose their ability to adequately engage the plug. Furthermore, a great deal of electrically conductive material goes into forming the entire contacts when only the bent ends are utilized, thereby increasing the cost of manufacturing.

Additionally, U.S. Pat. No. 5,522,738 to Lace, which issued Jun. 4, 1996, teaches an electrical connector jack with particular utility in telephones and musical instruments, namely, electric guitars. The jack taught in Lace attempts to reduce the audio feedback exhibited when inserting a plug therein and initially contacting a grounded portion of the jack. Therefore, the jack taught in Lace includes a shorting contact member electrically connected to the sleeve which prevents audio feedback when the plug is first inserted into a guitar. While the jack prevents, unnecessary audio feedback when connecting a plug, the jack still utilizes bent electrical contacts, thereby risking deformation thereof and incurring additional manufacturing costs.

While each of the devices disclosed in the above references are suitable for the uses and problems they intend to solve, there is an ongoing need for improvements in an audio output jack, such as one that reduces the probability of wear on the contacts thereof while simultaneously reducing the cost of manufacturing.

It is to this to which the present invention is directed.

SUMMARY OF THE INVENTION

The present invention provides in a first embodiment a mono audio output jack for use with an electrical device comprising:

(a) a ground contact member having a first end and an opposite second end;

(b) a positive contact member is at least partially insertable into the second end of the ground contact member;

(c) a first contact ring slidably insertable into the positive contact member;

(d) a second contact ring spaced apart from the first contact ring, the second contact ring slidably insertable into the positive contact member, the second contact ring receiving a conductive insert disposed within each of the pair of extensions, the second contact ring including a tab for securing an associated lead wire thereto:

(e) a sliding control member; and (f) first means for locking the ground contact member, the positive contact member, and the sliding control member to one another.

In a second embodiment hereof there is provided a "stereo" audio jack having a third contact ring for securing a second plug within the positive contact member to enable a left/right/ground assembly.

The present audio output jack has particular utility in connection with an electric or acoustic-electric musical instrument such as a guitar, bass, mandolin, ukulele, or the like.

An audio cable having a plug disposed on opposite ends of the audio cable may then be utilized to transfer an audio signal from the instrument to an exterior audio input device.

With the monaural jack the plug on each end of the audio cable includes a grounded sleeve and a tip extending therefrom. Thereafter, a plug on a first end of the audio cable is inserted into the first end of the ground contact member and engages each of the conductive inserts in the first and second contact rings. The tip engages a positive contact ring, thereby forming a completed electrical circuit within the instrument.

With the stereo or stereo phone jack, the ground control ring engages the sleeve, the second contact ring engages the left channel provided in the middle of the plug, and the third contact ring engages the right channel on the tip of the plug.

For a better understanding of the present invention, reference is made to the accompanying drawing and detailed description. In the drawing, like reference numerals refer to like parts through the several views, in which:

DETAILED DESCRIPTION OF THE INVENTION

As noted above, the present invention has particular utility in connection with an electric or an acoustic-electric musical instrument such as a guitar, bass, mandolin, ukulele, or the like. It is to be understood that the present invention can similarly be used in connection with any number of electric audio devices including telephones, audio recording devices, or the like. However, for purposes of clarity, reference will be made to the audio output jack being used in connection with an electric guitar throughout the ensuing description.

Figure 1:
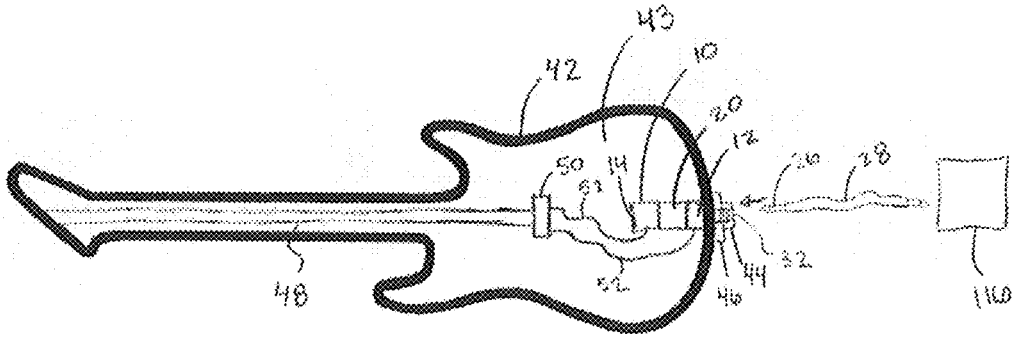
FIG. 1 is a cross-sectional view taken along the length of an electric guitar showing the use of a first embodiment of an audio output jack in accordance with the present invention.

Now, in accordance with the present invention and with reference to FIG. 1 of the drawing, there is shown an audio output jack denoted at 10 in use within an electric guitar 42. The audio output jack 10 hereof, which is disposed interiorly of the guitar 42, can be installed in an electric guitar 42 during the manufacturing process or, alternatively, be installed as a retrofit to replace an existing audio output jack.

It is to be understood that the construction of the guitar 42, per se, is not critical to the invention, only its use herewith.

The guitar 42 includes a plurality of guitar strings 48 and a pickup device 50, either disposed within or outside of the interior 43 of the guitar 42. The pickup device 50 recognizes vibrations in the strings 48 when they are strummed and generates an electrical signal caused by the vibrations. The pickup device 50 then transmits this electrical signal to the audio output jack 10 via a pair of lead wires 52 interconnecting the pickup device 50 and the audio output jack 10.

A substantial portion of the audio output jack 10 is disposed within the interior 43 of the guitar 42. The jack has a threaded first end 32 extending outside of the guitar 42. Means for fastening, such as a nut 44, and a removable plate or washer 46 are used to secure the threaded first end 32 to the exterior of the guitar 42. This ensures that the audio output jack 10 remains secured to the guitar 42 and does not become dislodged therefrom.

A plug 26 of an audio cable 28 is then able to be inserted into the first end 32 and secures the jack for transmitting an electrical signal to an audio input device 116, as described below.

Figure 2A:
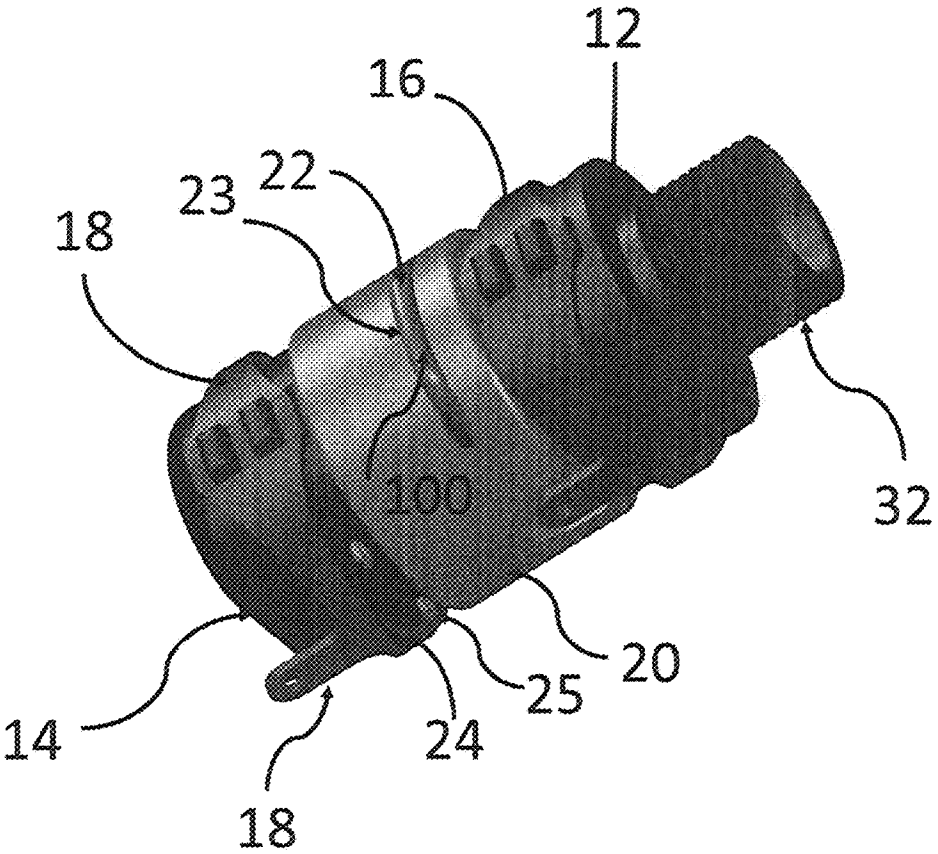
FIG. 2A is a perspective view of the audio output jack hereof.
Figure 2B:
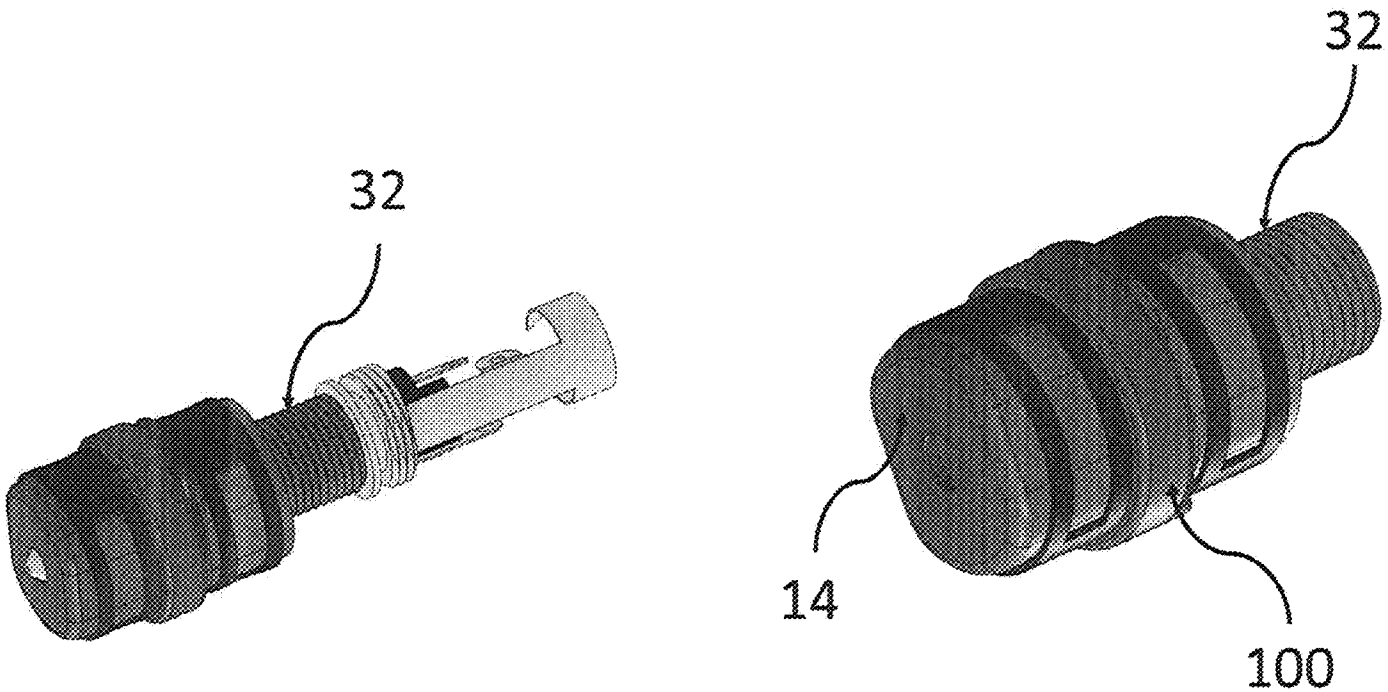
FIG. 2B is an assembled mono jack with the modified sliding control member and the contact ring of FIG. 7B.
Figure 3:
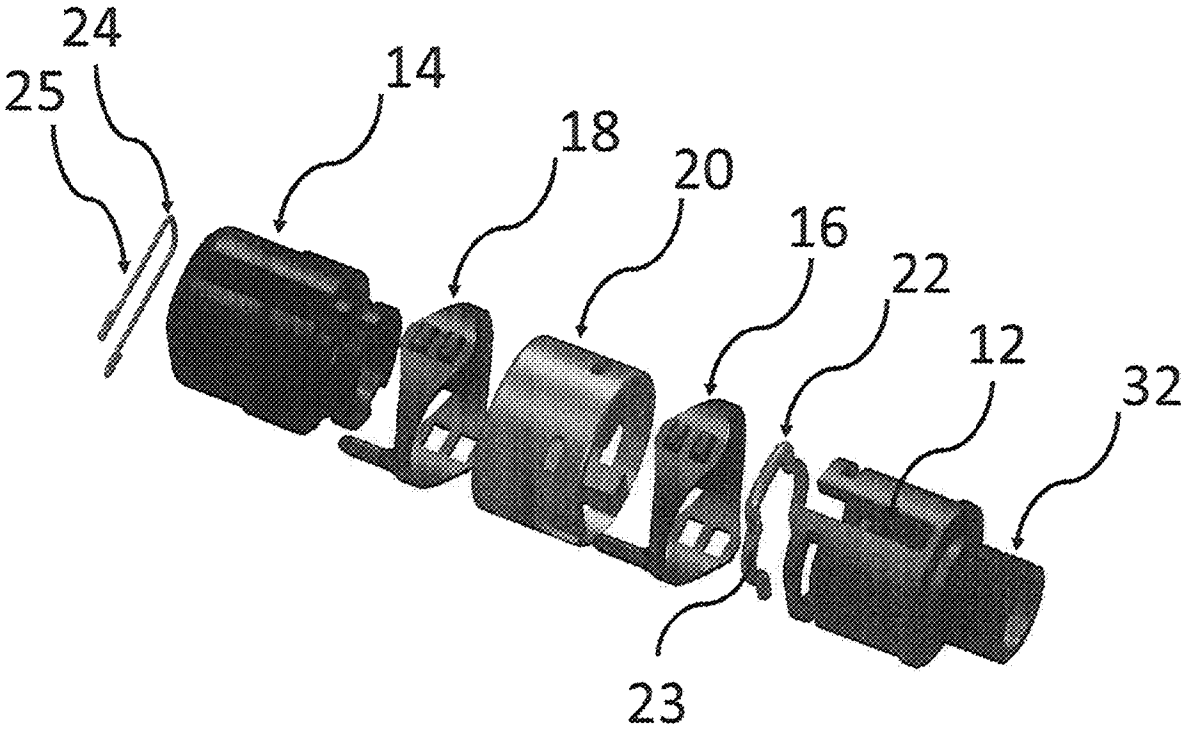
FIG. 3 is an exploded, perspective view of the audio output jack.
Figure 4:
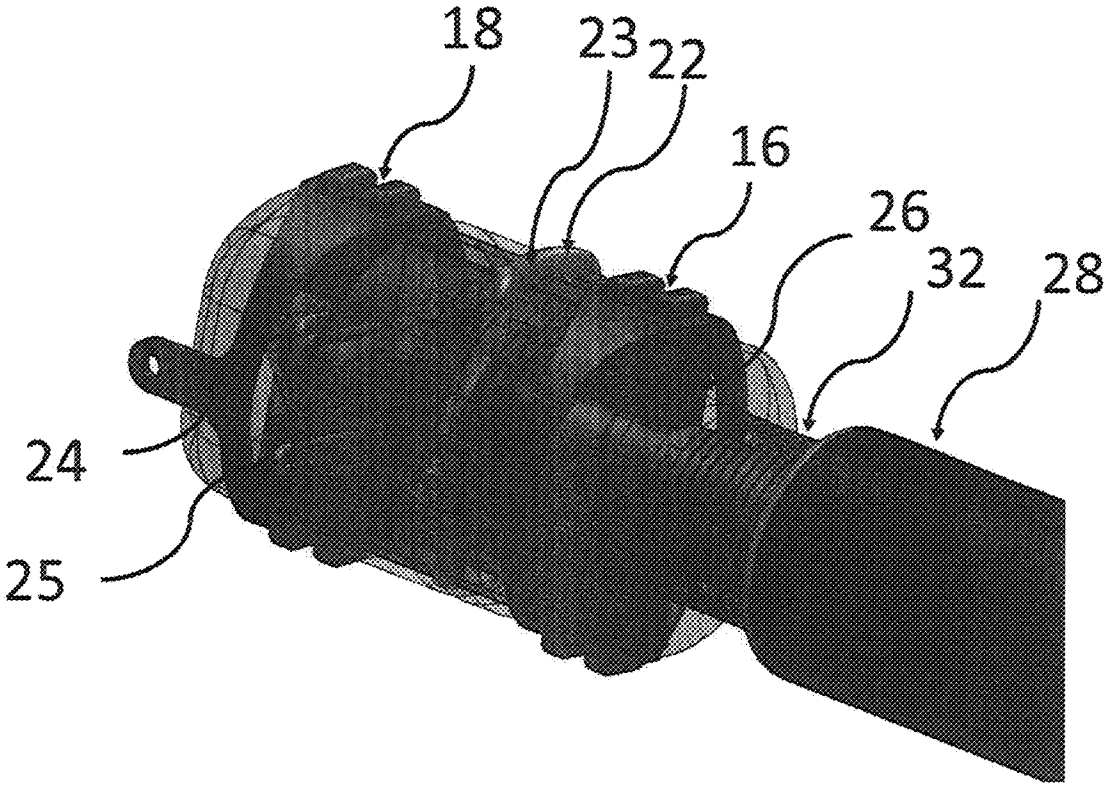
FIG. 4 is a perspective view of the assembled audio output jack having an audio cable plug inserted therein.

Referring now to FIGS. 2-4, in a first embodiment hereof the audio output jack 10 hereof, generally, comprises: (a) a ground contact member 12; (b) a positive contact member 14 partially insertable into the ground contact member 12; (c) a first contact ring 16 slidably engaging the ground contact member 12; (d) a second contact ring 18 slidably engaging the positive contact member 14; (e) a sliding control member 20 for maintaining the position of the first and second contact rings 16, 18; (f) first means 22 such as a clip, plurality of rods, or the like described below, the first means 22 for locking and unlocking the position of the ground contact member 12, the positive contact member 14, and the sliding control member 16; and (g) second means 24 such as a clip, plurality of rods, or the like described below, the second means 24 for removably securing a plug 26 of an audio cable 28 within the positive contact member 14 when inserted therein.

It is possible to simplify the construction here by eliminating the means 22, 24. As such, and with reference to FIG. 7B, there is shown an alternate contact ring 310. The ring 310 is formed as a resilient metal contact member having a cut-out section 312. Inwardly projecting, diametrically opposed engagement members, each having an arcuate terminus 316, 318, frictionally engage and hold that portion of the plug in contact therewith and when seated in an associating arcuate terminus 316 or 318.

Figure 5:
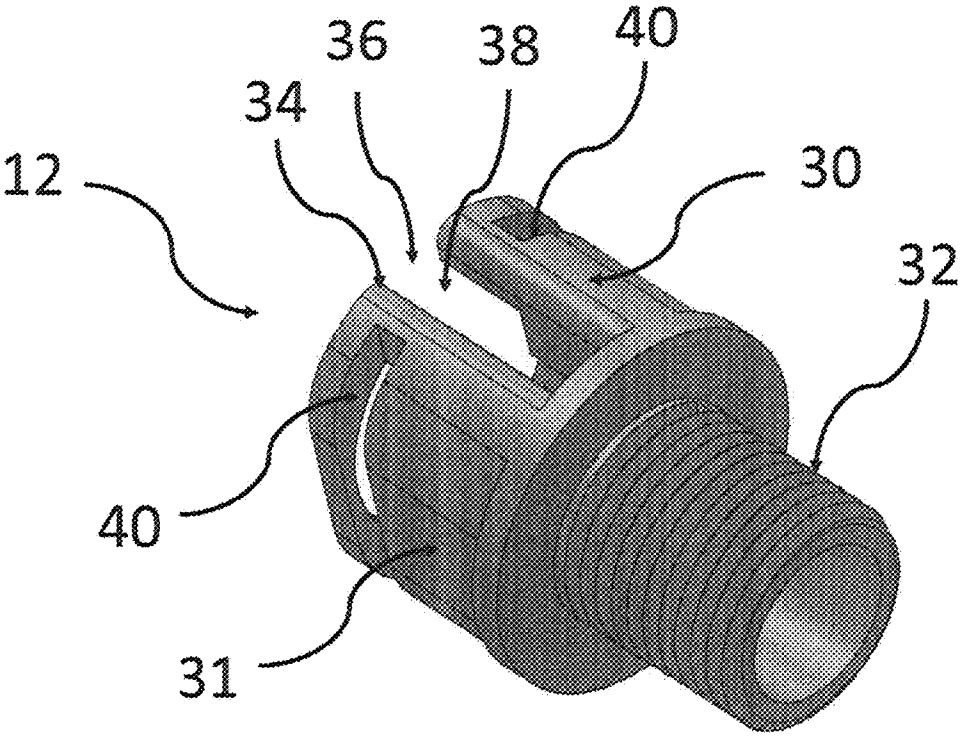
FIG. 5 is a perspective view of a ground contact member used herein.

As shown in FIG. 5, and with more particularity, the ground contact member 12 includes a substantially cylindrical first body or barrel 30 having an open interior 36. The first body 30 includes a wall 31, a threaded first end 32, and an opposite second end 34. The open interior 36 extends from both the first end 32 and the second end 34.

The ground contact member 12 further comprises a pair of diametrically opposed, elongated channels 38 formed in the wall 31 of the first body 30 for receiving the first contact ring 16, which acts as a negative in the electronic circuit formed hereby. The channels 38 extend from the second end 34 of the ground contact member 12 and terminate before reaching the first end 32.

The ground contact member 12 is provided with a pair of opposed openings 40 for receiving the first locking means 22. The openings 40 are formed within the wall 31 of the first body 30 and extend radially therearound between the channels 38.

Figure 6:
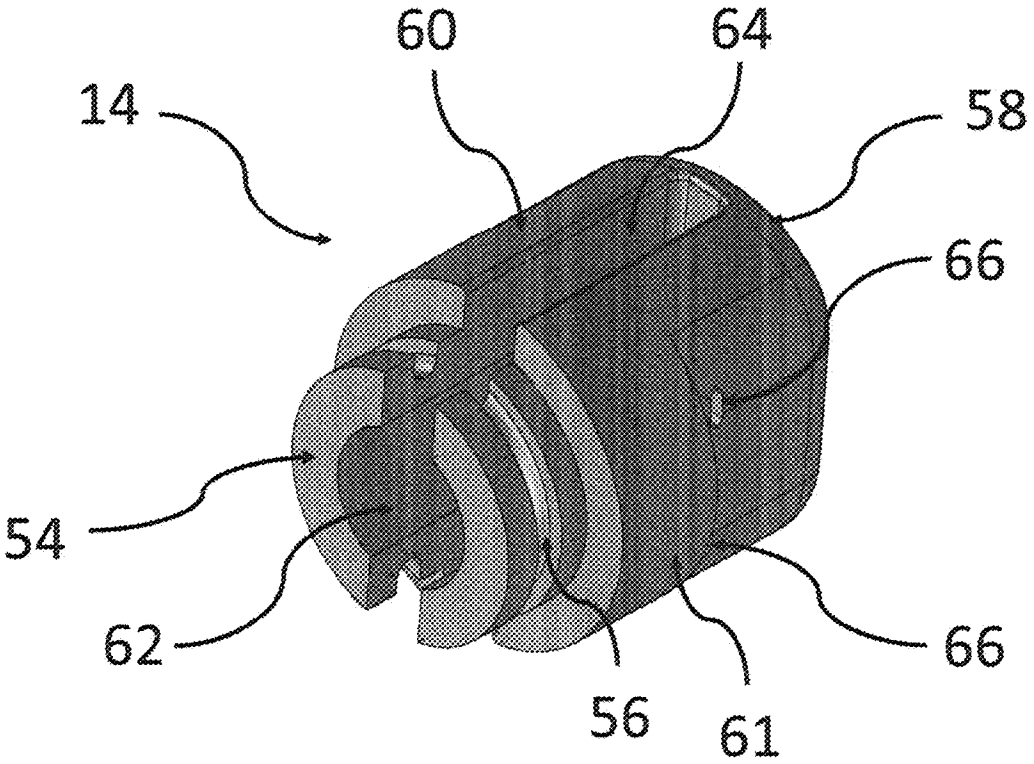
FIG. 6 is a perspective view of a positive contact member used herein.

As shown in FIG. 6, the positive contact member 14 comprises a substantially cylindrical second body 60 having a wall 61, a first end 54 and an opposite planar second end 58. The first end 54 includes a circumferential groove 56 formed therearound for removably receiving the first means 22. The positive contact member 14 includes an open interior 62 extending from the first end 54 and terminating at the planar second end 58.

The positive contact member 14 further comprises a pair of diametrically opposed, elongated channels 64 formed in the wall 61 of the second body 60 for receiving the second contact ring 18, which acts as a positive in the electronic circuit formed hereby. The channels 64 extend from the first end 54 of the positive contact member 14 and terminate before reaching the second end 58.

Where used, the positive contact member 14 is provided with a plurality of openings 66 (only one side being shown) formed within the wall 61 of the second body 60 for removably receiving the second means 24. The openings 66 are in alignment and in registry and correspondence with similar alignment holes diametrically opposed on the other side of the wall 61. When not in use, the arcuate contacts of the ring 310 can provide the contact area. Thereby eliminating the need for the openings 66 and the second means 24.

Figure 7A:
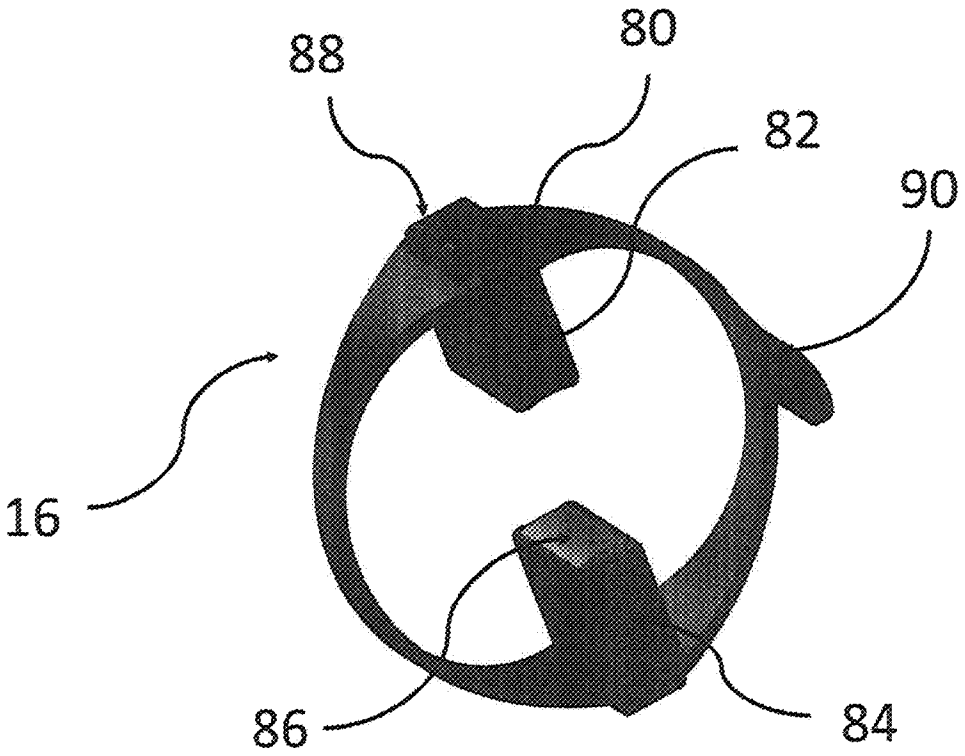
FIG. 7A is a perspective view of a contact ring used herein.
Figure 7B:
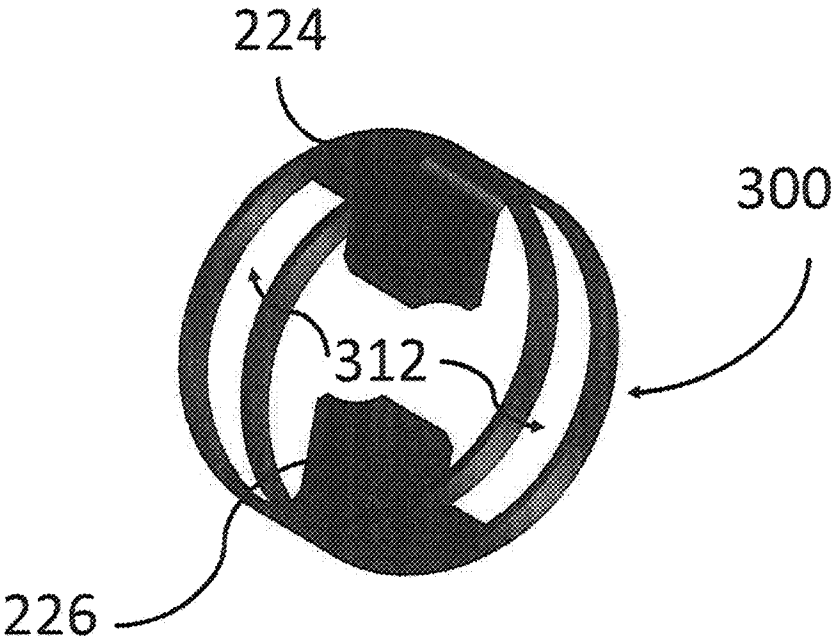
FIG. 7B is a perspective view of an alternate embodiment of a contact ring for use herein.
Figure 8:
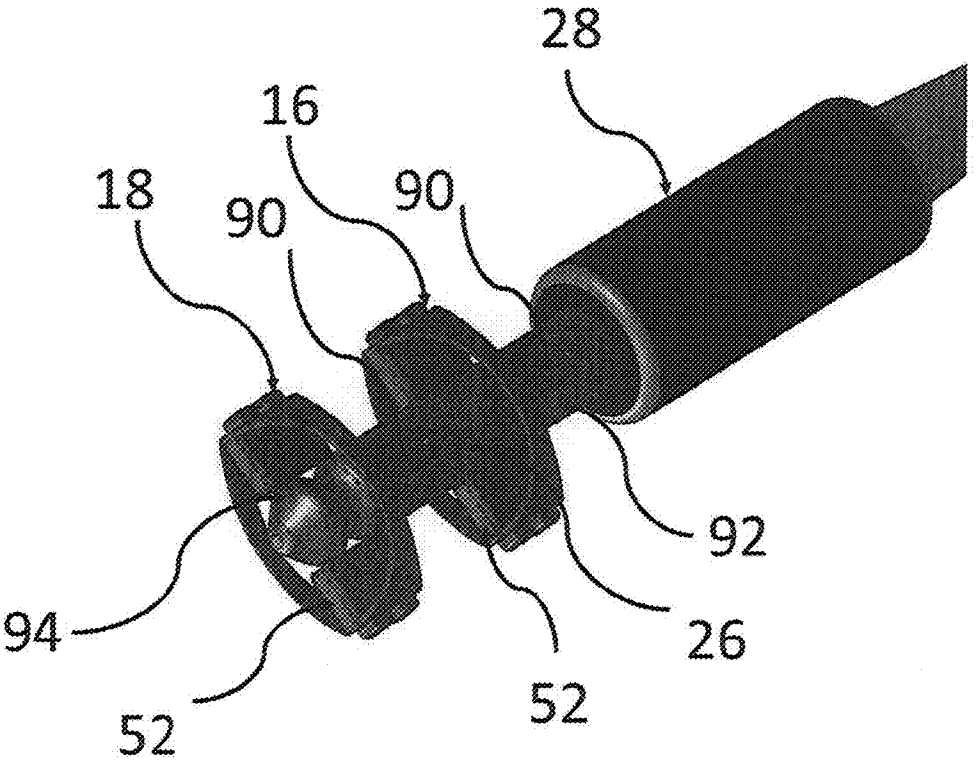
FIG. 8 is a perspective view of the first contact ring and a second contact ring engaging the plug of the audio cable.

With reference to FIGS. 7 and 8, the contact rings 16, 18 are shown in more detail. The first and second contact rings 16, 18 are identical in structure so, for purposes of simplicity, only the first contact ring 16 will be described.

The contact ring 16 includes a circular frame 80 and a pair of diametrically opposed, hollow extensions 82, 84 extending inwardly toward a center of the frame 80. The contact ring 16 is formed from a conductive material and, preferably, a copper alloy. Alternatively, and as shown in FIG. 7B, the ring may comprise a single metallic ring formed from copper/copper alloy or the like with cutouts and forming the extensions in the unitary ring.

A conductive insert 86 is disposed or seated within each of the extensions 82, 84 for engaging the plug 26 when inserted into the audio output jack 10. Each conductive insert 86 is a highly conductive material having a galvanized layer such as gold, nickel plated copper, or steel. Preferably, the conductive inserts 86 are galvanized gold. Alternatively, the conductive used may comprise a unitary member.

Each extension 82, 84 includes a spring-loaded plunger 88 that enables the respective conductive insert 86 to extend and retract therein. Extension of the conductive inserts 86 facilitates a strong contact point between the conductive inserts 86 and the plug 26. When the ring is formed from a resilient material, the plunger 88*s* is not necessary.

The contact ring 16 may comprise a tab 90 extending radially from the frame 80 for attaching one of the lead wires 52 of the pickup 50 thereto by any suitable method such as by soldering or the like.

Figure 9:
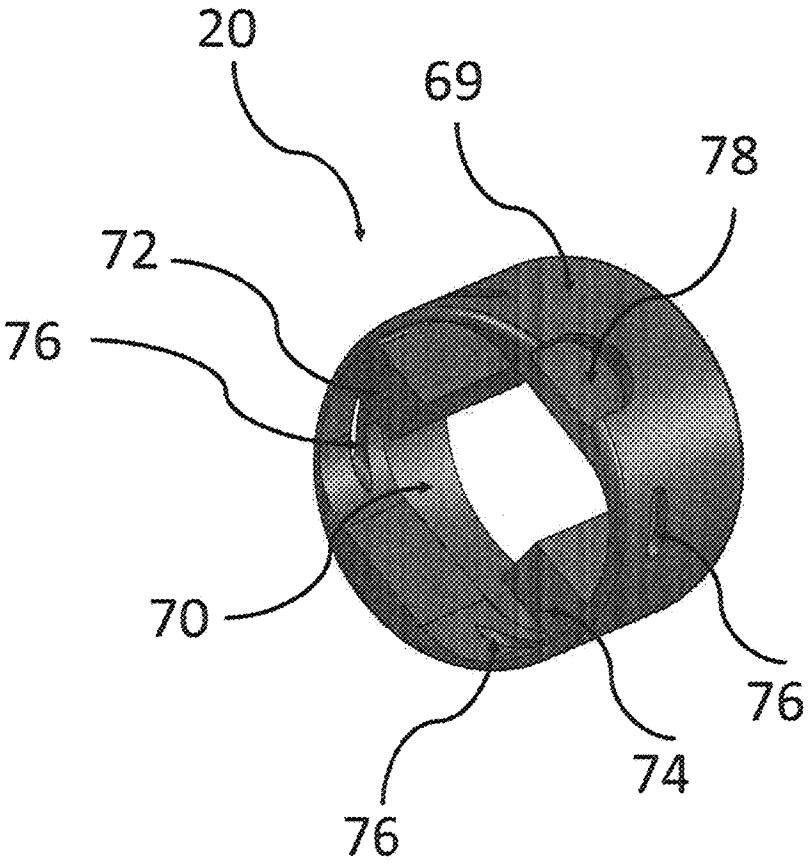
FIG. 9 is a perspective view of a sliding control member used herein.

As shown in FIG. 9, the sliding control member 20 prevents incidental sliding of the contact rings 16, 18 when disposed on the ground contact member 12 and positive contact member 14, respectively. The sliding control member 20 comprises a substantially cylindrical third body 68 having a wall 69 with a diameter slightly larger than the diameter of the ground contact member 12 and the positive contact member 14 such that the sliding control member 20 can be disposed therearound.

The sliding control member 20 includes a substantially open interior 70 and a pair of diametrically opposed arms 72, 74 extending inwardly into the open interior 70.

As noted below, the arms 72, 74 are slidably inserted into respective channels 38, 64 of the ground contact member 12 and the positive contact member 14 for preventing the contact rings 16, 18 from moving out of position.

The sliding control member 20 is provided with a plurality of openings 76 formed within the wall 69 of the third body 68 for removably receiving the first means 22. Furthermore, the sliding control member 20 includes an indentation 78 formed within the wall 69 of the third body 68 for receiving a portion of the second contact ring 18.

Figure 16:
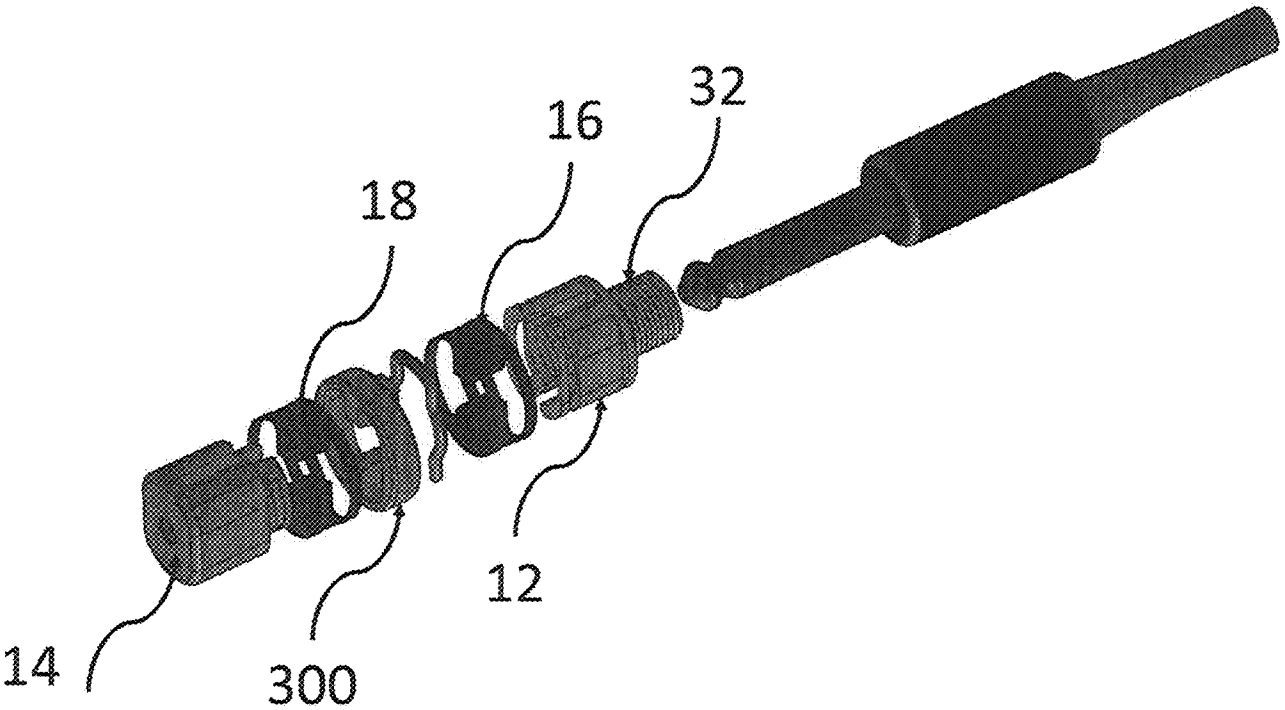
FIG. 16 is an exploded perspective view of the mono jack including a modified control member.
Figure 17A:
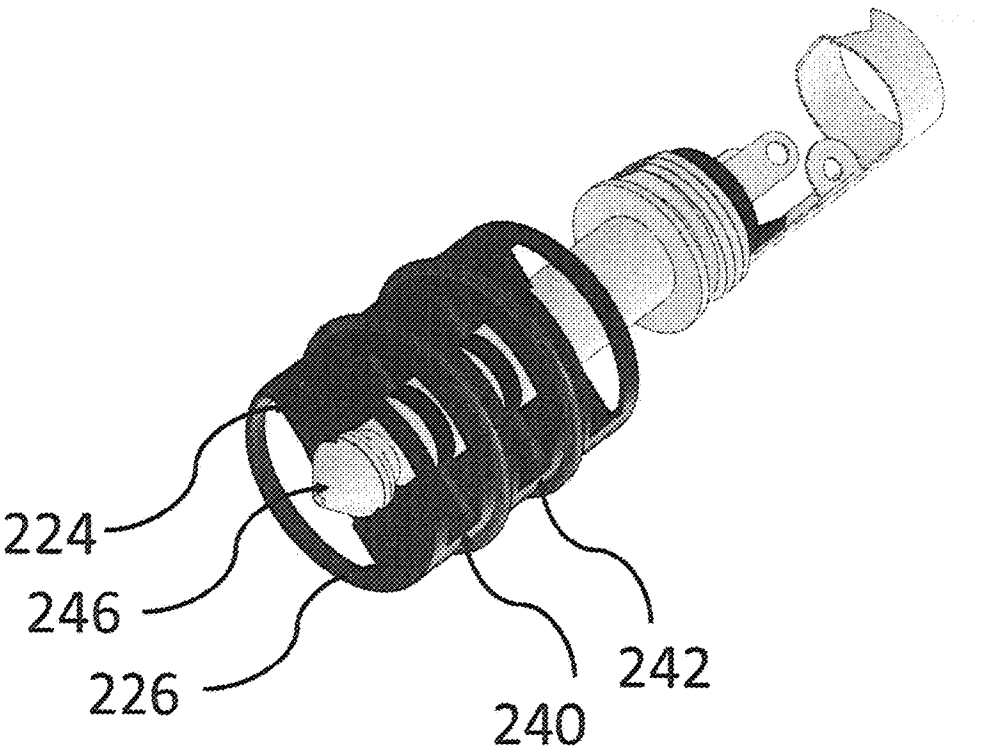
FIG. 17A is a perspective view of a second embodiment hereof defining a stereo jack with parts eliminated for simplicity.
Figure 17B:
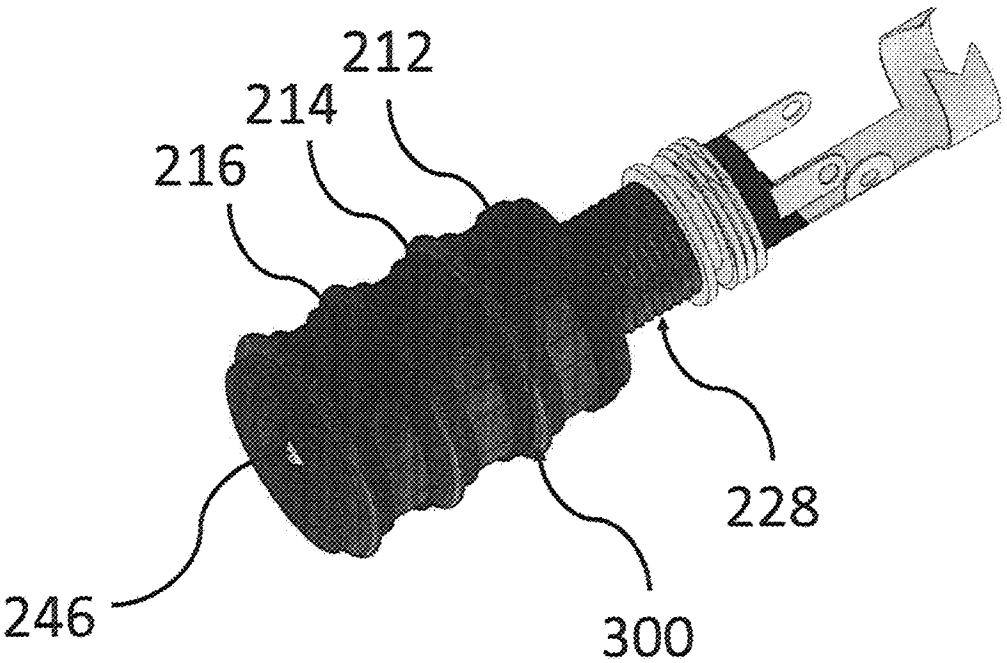
FIG. 17B depicts an assembled stereo jack of FIG. 17A.
Figure 18:
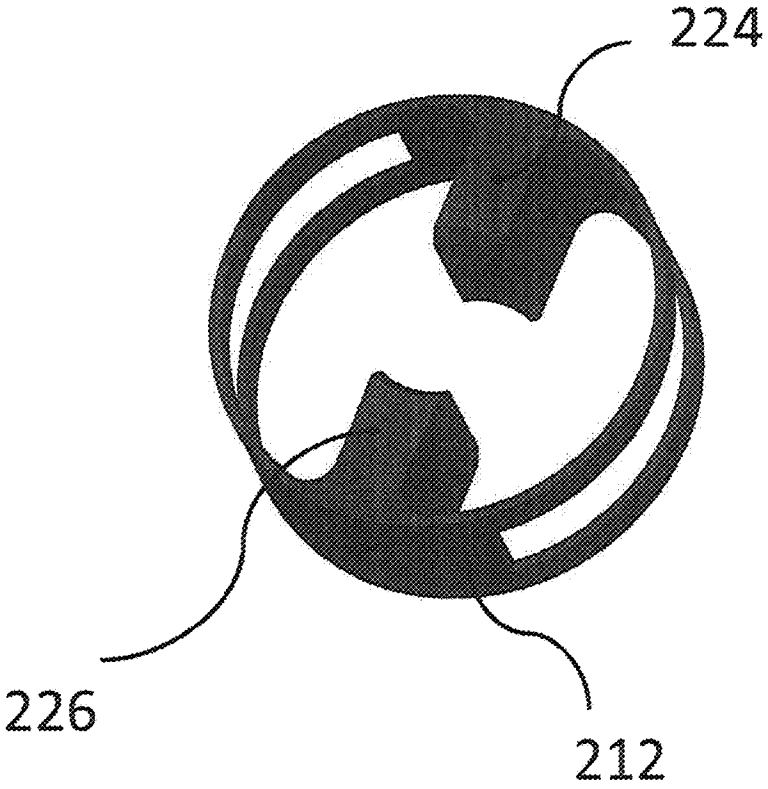
FIG. 18 is a perspective view of an alternate contact ring for use with the stereo jack.
Figure 19:
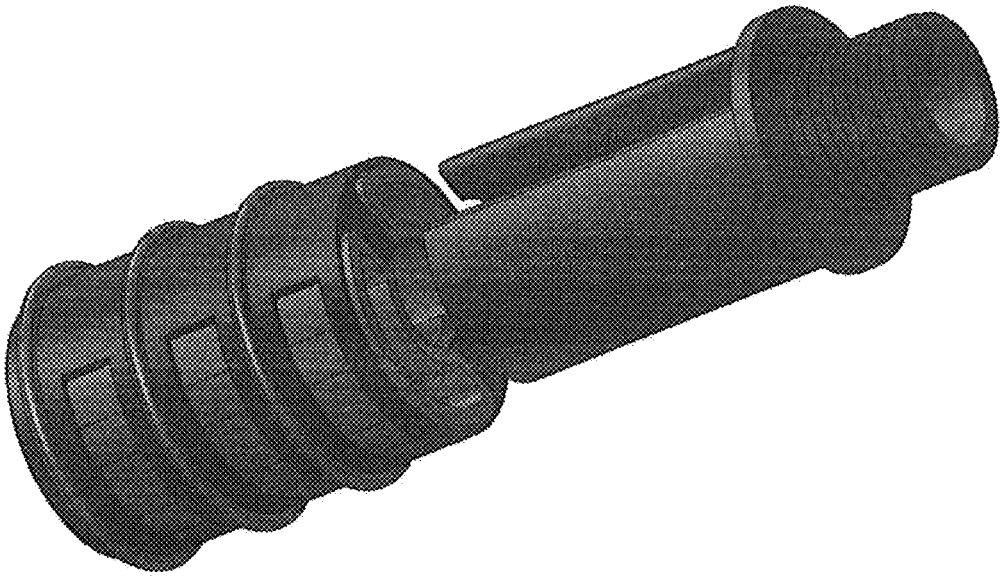
FIG. 19 is a partial perspective view showing the interconnection between the barrel of the jack and the contact rings.

Alternatively, and as shown in FIGS. 16 and 2B, the control member 20 may comprise a non-conductive annular member 21 having inwardly extending projections 23, 23' which are slidingly insertable into the associated channel of the ground and positive contact members to prevent siding.

Now referring to FIGS. 10-15, the assembly of the audio output jack 10 hereof is described with respect to the cooperation between the above components as set forth below.

Figure 10:
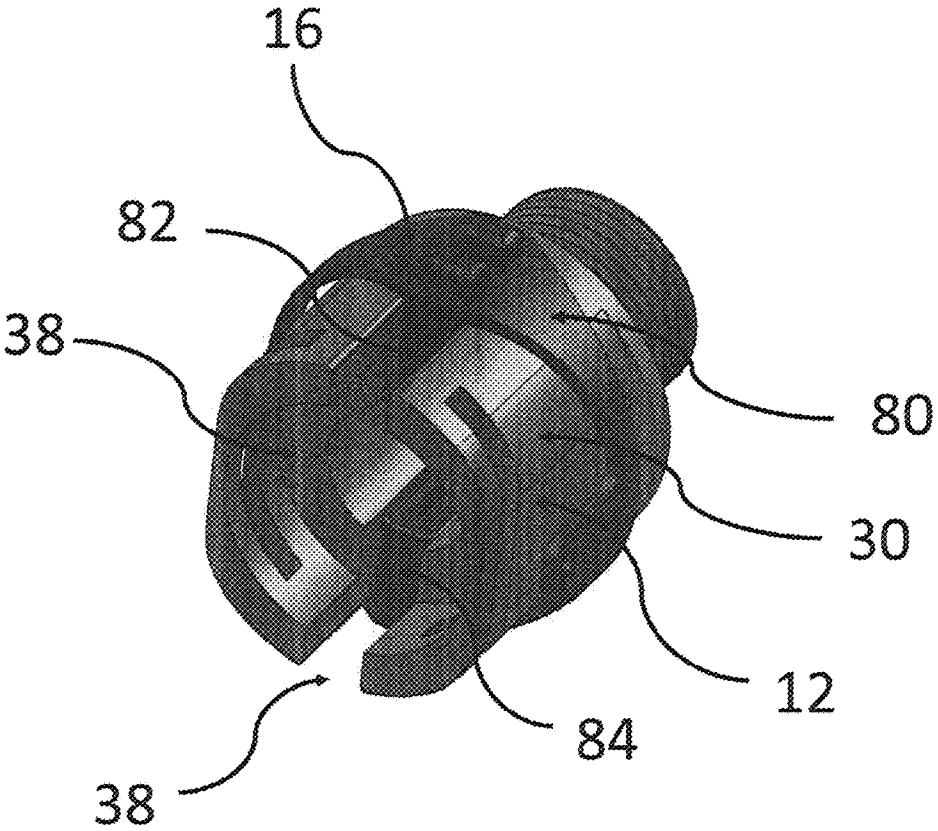
FIG. 10 is a perspective view of the ground contact member.

Specifically, FIG. 10 demonstrates the first contact ring 16 sliding into engagement with the ground contact member 12 by aligning the extensions 82, 84 of the first contact ring 16 with respective channels 38 of the ground contact member 12 and sliding the first contact ring 16 therein. The frame 80 of the first contact ring 16 then encircles the first body 30 of the ground contact member 12.

Figure 11:
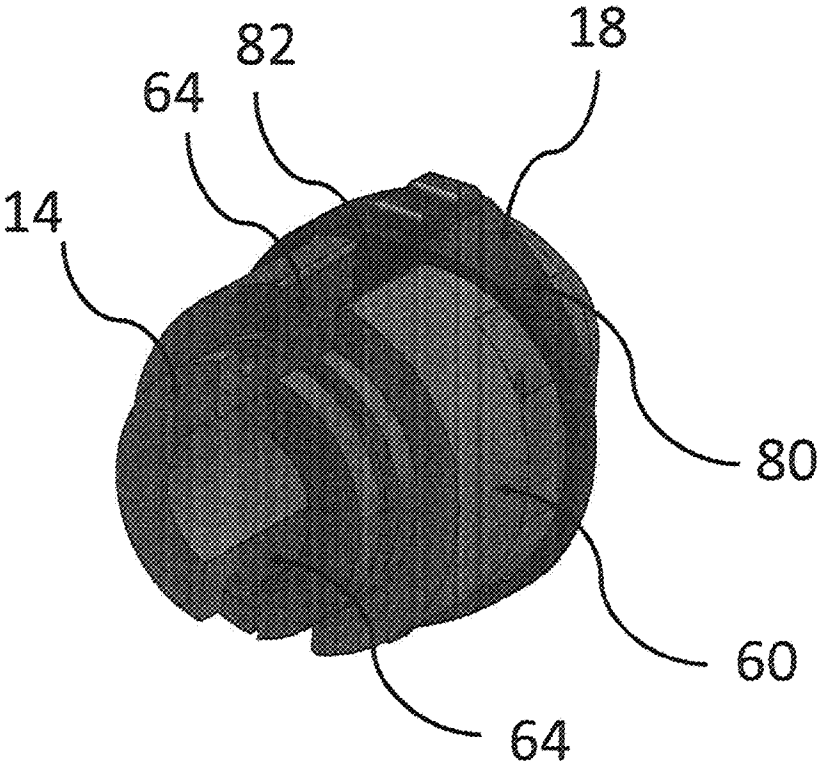
FIG. 11 is a perspective view of the second contact ring slidably engaging the positive contact member.
Figure 12:
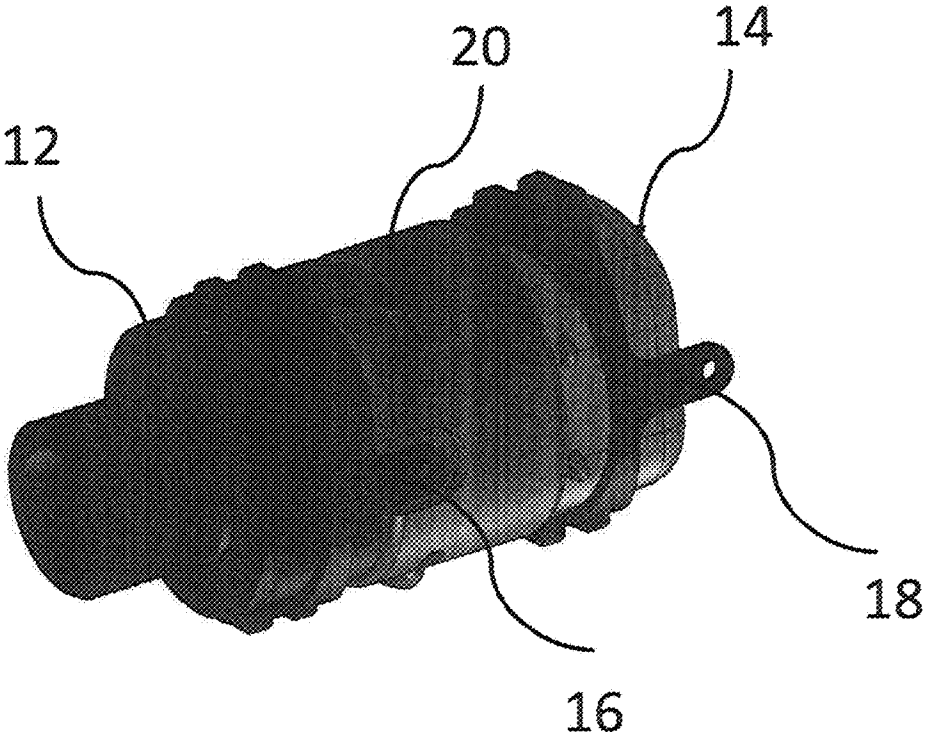
FIG. 12 is a partial perspective view of the assembled audio output jack.

Similarly, FIG. 11 demonstrates the second contact ring 18 sliding into engagement with the positive contact member 14 by aligning the extensions 82, 84 of the second contact ring 18 with respective channels 64 of the positive contact member 14 and sliding the second contact ring 18 therein. The frame 80 of the second contact ring 18 similarly encircles the second body 60 of the positive contact member 14.

Once the contact rings 16, 18 are inserted into the ground contact member 12 and the positive contact member 14, respectively, the sliding control member 20 is inserted between the contact rings 16, 18 to prevent the contact rings 16, 18 from sliding out of position. In doing so, the positive contact member 14 is partially inserted into the ground contact member 12 with the sliding control member 20 encircling a portion of both the ground contact member 12 and the positive contact member 14.

Figure 14:
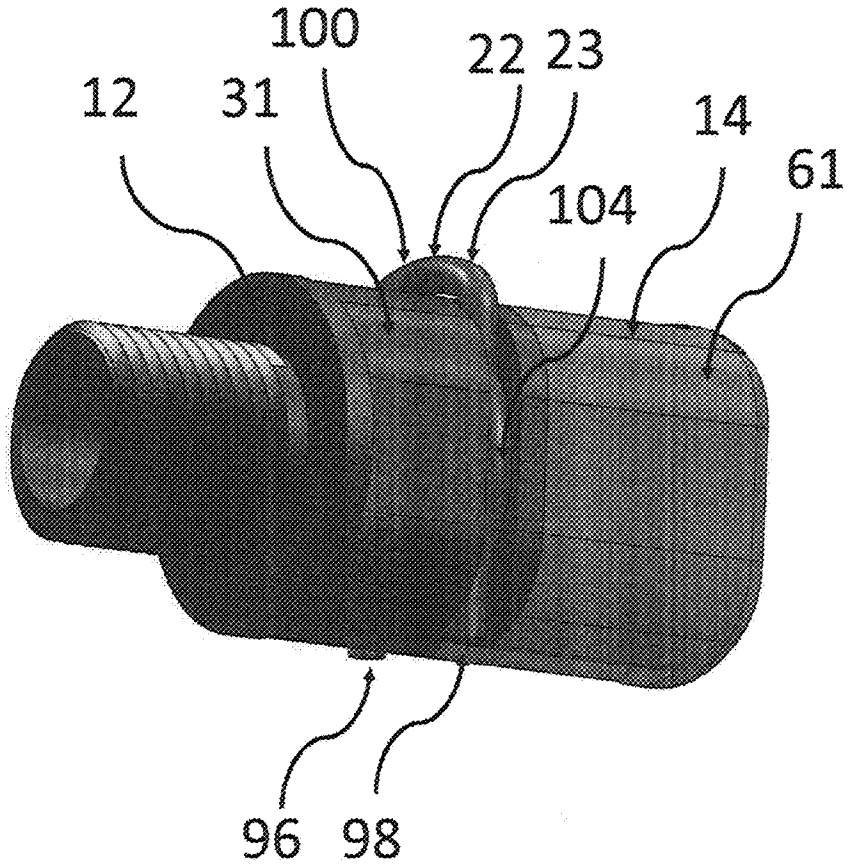
FIG. 14 is a perspective view of the body locking bar engaging the ground contact member and the positive contact member.

The partial insertion of the positive contact member 14 into the ground contact member 12 is more clearly shown in FIG. 14 with the sliding control member 20 removed. Once the first end 54 of the positive contact member 14 is inserted into the second end of the ground contact member 12, the groove 56 in the first end 54 of the positive contact member 14 is in registry with the openings 40 of the ground contact member 12. This allows the first means 22 to be inserted through the respective openings 40, 66, 76 and lock the ground contact member 12, the positive contact member 14, and the sliding control member 20 together.

Figure 13:
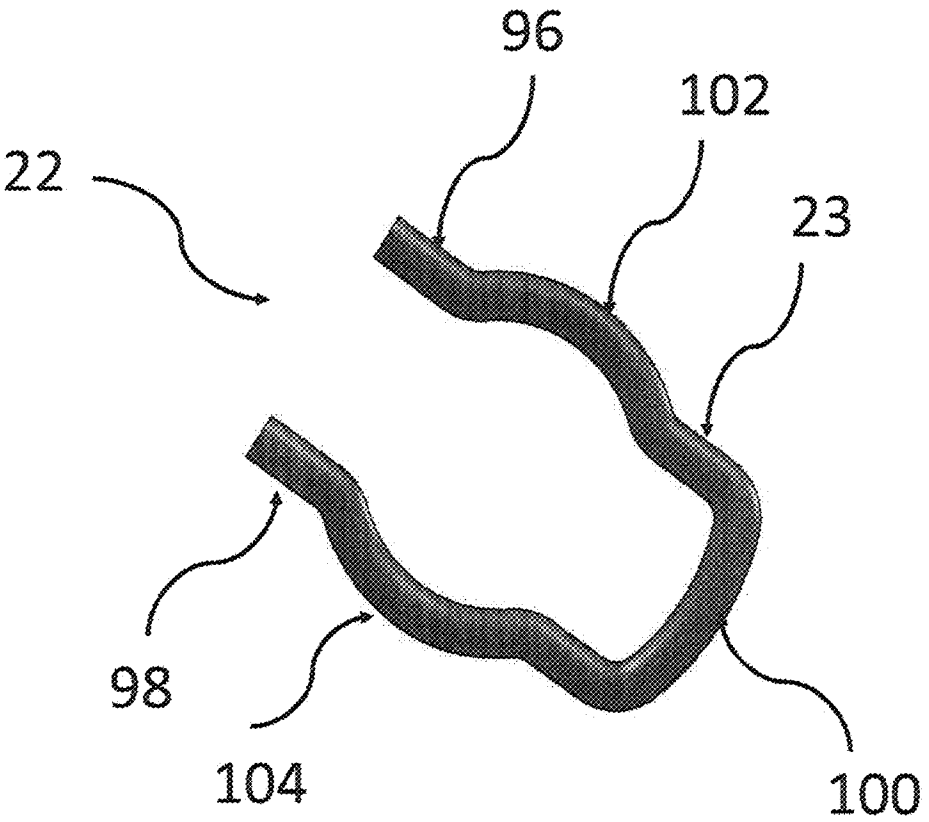
FIG. 13 is a perspective view of a body locking bar used herein.

The first means 22 comprises any suitable clip, rod, or the like. As shown in FIG. 13, preferably, the first means 22 is a body locking bar 23 including a medial section 100 and a pair of substantially parallel legs 96, 98 extending from opposite ends of the medial section 100 at a substantially right angle. Each leg 96, 98 includes an outwardly protruding arc 102, 104, respectively, conforming to the groove 56 of the positive contact member 14.

With reference, again, to FIG. 2, the fully assembled audio output jack 10 can be seen with the body locking bar 23 partially extending out of an opening 76 of the sliding control member 20. The medial section 100 is left exposed outside of the sliding control member 20 to facilitate removal thereof and disassembling of the audio output jack 10.

Figure 15:
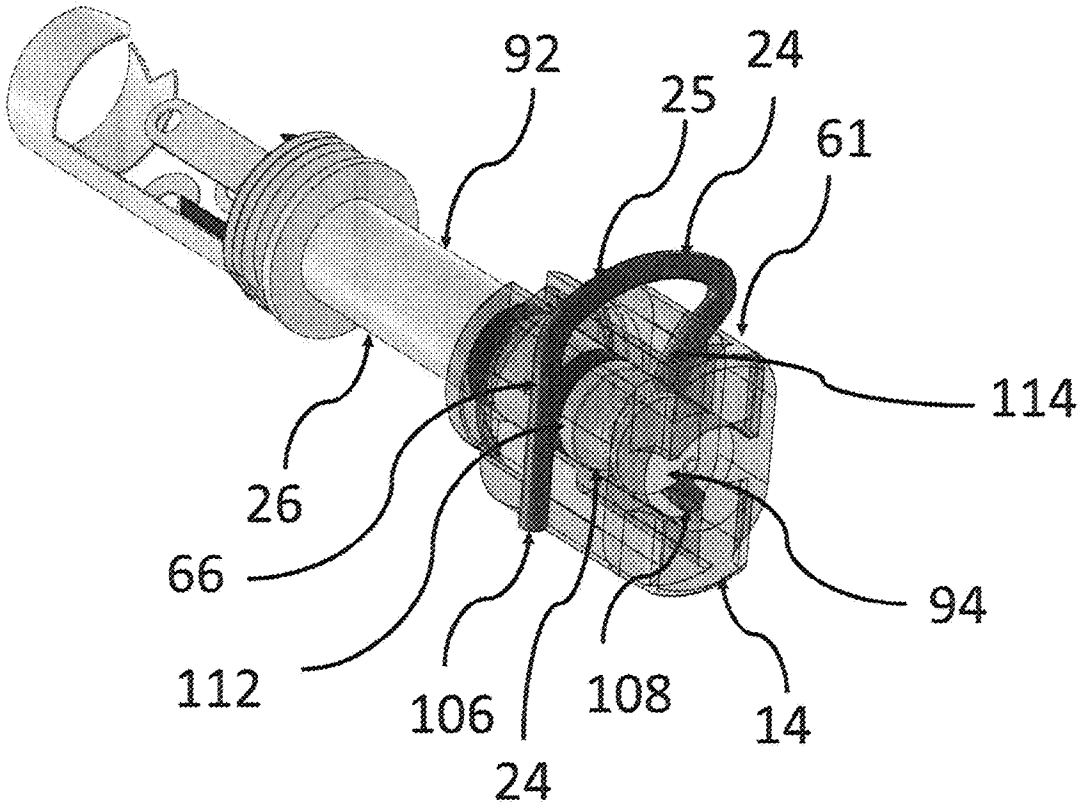
FIG. 15 is a perspective view of a plug locking bar used herein engaging the positive contact member and the plug of the audio cable.

Furthermore, the second means 24, is inserted into the positive contact member 14 and engages the plug 26 to ensure that the plug 26 remains secured within the audio output jack 10. As shown in FIG. 15, preferably, the second means 24 is a plug locking bar 25 including a pair of substantially parallel legs 106, 108 extending from opposite ends of a substantially right angle. Each leg 106, 108 includes an inwardly protruding arc 112, 114, respectively, so as to fit between the sleeve 92 and the tip 94 of the plug 26 and secure the plug 26 in place within the positive contact member 14.

The legs 106, 108 of the plug locking bar 25 are inserted into respective openings 66 formed in the wall 61 of the positive contact member 14 and extend therethrough. The medial section 110 of the plug locking bar 25 remains exposed outside of the positive contact member 14 to facilitate removal thereof when necessary.

The legs 106, 108 exhibit a minimal amount of flexibility with respect to the medial section 110. This flexibility provides a slight increase in the spacing between the legs 106, 108 when the plug 26 is inserted therebetween. Therefore, when the plug 26 is inserted into the audio output jack 10, the legs 106, 108 provide a "clicking" sound to indicate that the plug 26 has been properly positioned within the audio output jack 10. When force is applied to remove the plug 26 from the audio output jack 10, the legs 106, 108 separate slightly allowing the plug 26 to be removed.

The above components, including the ground contact member 12, the positive contact member 14, and the sliding control member 20, need not be formed from conductive materials, only, and, therefore, may be formed from either, metal, plastic, or the like. The only components that are required to be formed from a conductive material are the contact rings 16, 18 and the conductive inserts 86 disposed therein which form the completed electrical circuit when in contact with the plug 26.

In use, and referring now to FIGS. 8 and 15, the electrical circuit between the audio output jack 10 and the plug 26 is formed as the contact rings 16, 18 engage specific portions of the audio cable 28. The plug 26 of the audio cable 28 comprises an elongated, grounded sleeve 92 and a positively charged tip 94. Specifically, when the plug 26 is inserted into the audio output jack 10, the first contact ring 16 engages the sleeve 92 and the second contact ring 18 engages the tip 94. When the lead wires 52 are connected to respective tabs 90 on the contact rings 16, 18, the conductive inserts 86 disposed therein contact the sleeve 92 and the tip 94 of the plug 26, respectively, to form the completed electrical circuit.

As noted above, FIG. 16 depicts an embodiment of the mono jack which, when assembled, uses the contact member of FIG. 7B for both the ground and positive contact 14, 16, respectively. Additionally, the control member 100 comprises a non-conductive annular ring having opposed projections 23, 23' which slidingly receive the positive contact member 14.

Referring now to FIGS. 17-20, there is depicted a second embodiment hereof. According to this embodiment, there is provided a stereo audio output jack, generally, denoted at 210.

The jack 210 comprises three contact rings 212, 214 and 216, each constructed similarly to contact rings 16 and 18 of the first embodiment of FIG. 7A or the contact ring 300 of FIG. 7 B. In all other respects the construction is the same as the mono jack but adds an additional contact member. Thus, the jack 210 includes a left contact member 218, a right contact member 220 and a ground contact member 222 to define a left/right ground stereo jack.

As shown, each contact member includes inwardly directed conductive inserts 224,226 which are biased toward and engage a plug 228.

Alternatively, the plunger assembly described with respect to the first embodiment may be used.

As shown, each contact ring has jack lead wires (not shown) connected thereto.

Each contact member is separated by isolator spacers 240, 242. The spacers are non-conductive and, preferably, are plastic members.

Figure 20:
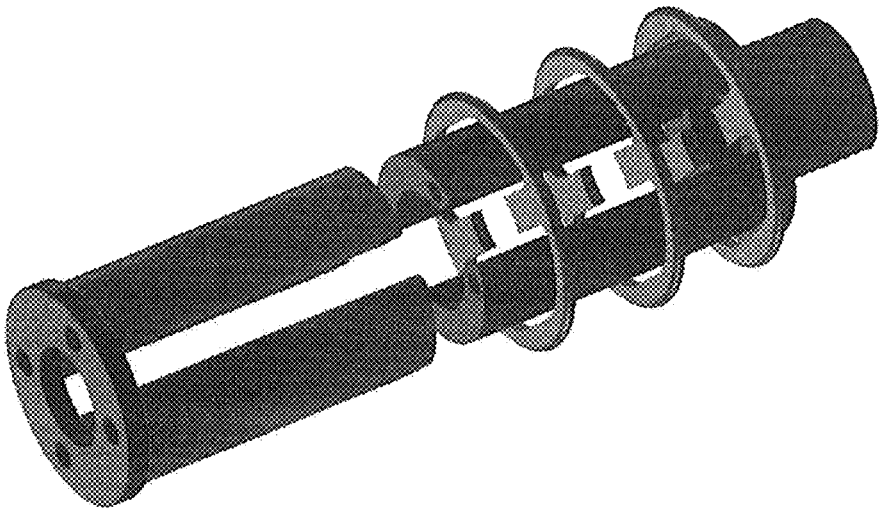
FIG. 20 is a partial assembly view, similar to FIG. 20 but showing the interconnection between the barrel and the right channel of the stereo jack.

As shown in FIG. 20, when assembled the ground member slidingly projects into the channels created by the cooperation between the spacers and the contact rings.

The central plug 228 is inserted into the barrel of the metal carrier with its terminal tip 246 extending outwardly from the tip of the sliding control member.

The peripheral tabs register with openings in the control member.

The carrier interlocks with the contact members within the channels as described above.

While the individual components of the audio output jack 10 may be machine manufactured, the audio output jack 10 is assembled manually. This provides the added benefit that individual components of the audio output jack 10 may be separately serviced and replaced.

From the above, it is to be appreciated that defined herein is a new and unique audio output jack that provides an enhanced audio signal while avoiding common wear and tear exhibited in standard audio output jacks.

The invention claimed is:

1. An audio output jack comprises:

(a) a ground contact member;

(b) a positive contact member partially insertable into the ground contact member;

(c) a first contact ring slidably engaging the ground contact member;

(d) a second contact ring slidably engaging the positive contact member;

(e) a control member for maintaining the position of the first and second contact rings; and (f) first means for locking and unlocking the position of the ground contact member, the positive contact member, and the control member.

2. The jack of claim 1, wherein the ground contact member includes a substantially cylindrical first body having an open interior, the first body including a wall, a threaded first end, and an opposite second end, the open interior extending from the first end to the second end.

3. The jack of claim 2 wherein, the ground contact member further comprises a pair of diametrically opposed, elongated channels formed in the wall of the first body for receiving the first contact ring, the channels extending from the second end of the ground contact member and terminating before reaching the first end.

4. The jack of claim 1 wherein the positive contact member comprises:

a substantially cylindrical second body having a wall;

a first end;

an opposite planar second end;

the first end including a circumferential groove formed therearound for removably receiving the first means, the positive contact member including an open interior extending from the first end and terminating at the planar second end.

5. The jack of claim 4 wherein the positive contact member further comprises:

a pair of diametrically opposed, elongated channels formed in the wall of the second body for receiving the second contact ring, which acts as a positive in the electronic circuit formed hereby, the channels extending from the first end of the positive contact member and terminate before reaching the second end.

6. The jack of claim 1, wherein the contact ring includes a circular frame and a pair of diametrically opposed, hollow extensions extending inwardly toward the center of the frame, the contact ring being formed from a conductive material.

7. The jack of claim 6 wherein each extension includes a spring-loaded plunger for enabling the respective conductive insert to extend and retract therein.

8. The jack of claim 1 wherein: the sliding control member comprises a substantially cylindrical body having a wall with a diameter slightly larger than the diameter of the ground contact member and the positive contact member such that the sliding control member can be disposed therearound, the control member including a substantially open interior and a pair of diametrically opposed arms extending inwardly into the open interior, the arms being slidably inserted into respective channels of the ground contact member and the positive contact member for preventing the contact rings from moving out of position.

9. The jack of claim 8 wherein the sliding control member is provided with a plurality of openings formed within the wall of the cylindrical body for removably receiving the first means.

10. The jack of claim 1 where the first means comprises a body locking bar including a medial section and a pair of substantially parallel legs extending from opposite ends of the medial section at a substantially right angle, each leg including an outwardly protruding arc, conforming to the groove of the positive contact member.

11. The jack of claim 1 including a plug locking bar having a medial section and a pair of substantially parallel legs extending from opposite ends of the medial section at a substantially right angle, each leg including an inwardly protruding arc fitted between the sleeve and the tip of the plug to secure the plugin place within the positive contact member.

12. The jack of claim 1 which further comprises:

a first medial section, the positive contact member, a second medial section and ground contact member cooperating to define a stereo audio output jack.

13. The jack of claim 12 wherein each contact ring is a conductive unitary annular member having opposed inwardly detected projections having arcuate termini, an audio plug having portions thereof seated in associated termini.

14. The jack of claim 1 wherein the audio jack defines a left channel member, a right channel member and a ground member.

15. The jack of claim 1 wherein the control member is an annular non-conductive spacer member disposed between the ground contact member and the positive contact member.

16. The jack of claim 12 wherein the control member is an annular non-conductive spacer member disposed between the ground contact member and the positive contact member.

17. The jack of claim 1 wherein each contact ring is a conductive unitary annular member having opposed inwardly detected projections having arcuate termini, an audio plug having portions thereof seated in associated termini.

* * * * *